United States Patent [19]

Byerley

[11] Patent Number: 4,485,069

[45] Date of Patent: Nov. 27, 1984

[54] MOISTURE SEPARATOR REHEATER WITH ROUND TUBE BUNDLE

[75] Inventor: Wilbur M. Byerley, Riverview, Fla.

[73] Assignee: Westinghouse Electric Corp., Pittsburgh, Pa.

[21] Appl. No.: 341,036

[22] Filed: Jan. 20, 1982

[51] Int. Cl.[3] ..... G21C 15/00; F22G 1/00; F22B 1/16; F22B 37/26

[52] U.S. Cl. ..... 376/405; 122/483

[58] Field of Search ..... 122/483; 376/285, 286, 376/402, 405, 461

[56] References Cited

U.S. PATENT DOCUMENTS

| | | | |
|---|---|---|---|
| 3,438,430 | 4/1969 | Kestemont | 376/402 |
| 3,996,897 | 12/1976 | Herzog | 122/483 |
| 4,019,881 | 4/1977 | Herzog et al. | 122/483 |
| 4,103,647 | 8/1978 | Dorling et al. | 122/483 |
| 4,223,722 | 9/1980 | Shade, Jr. | 722/483 |
| 4,300,481 | 11/1981 | Fisk | 122/483 |
| 4,302,227 | 11/1981 | Miller | 122/488 |
| 4,336,614 | 6/1982 | Mitchell et al. | 376/405 |
| 4,342,721 | 8/1982 | Poime et al. | 376/405 |
| 4,371,035 | 2/1983 | Soligno | 376/405 |

FOREIGN PATENT DOCUMENTS

| | | | |
|---|---|---|---|
| 2854499 | 6/1980 | Fed. Rep. of Germany | 376/405 |
| 1255512 | 12/1971 | United Kingdom . | |

*Primary Examiner*—Sal Cangialosi

*Attorney, Agent, or Firm*—F. J. Baehr, Jr.

[57] ABSTRACT

A moisture separator reheater having a central chamber with cylindrical wall portions and a generally round tube bundle, the tube bundle having arcuate plates disposed on each side of the bundle which form a wrapper on each side of the tube bundle and having a tongue and groove juncture between the wrapper and cylindrical wall portions to provide a seal therebetween and a track for installing and removing the tube bundle from the central chamber.

4 Claims, 2 Drawing Figures

MOISTURE SEPARATOR REHEATER WITH ROUND TUBE BUNDLE

BACKGROUND OF THE INVENTION

This invention relates to moisture separator reheaters for nuclear power plants and more particularly to moisture separator reheaters with round tube bundles.

In nuclear power plants, moisture separator reheaters are disposed between high and low pressure turbines. The moisture separator reheaters function to remove moisture from the motive steam and reheat it to a superheated condition. The superheated condition of the motive steam entering the low pressure turbine reduces blade erosion within the turbine and improves and heat rate or operating efficiency thereof.

With the current emphasis on reduced energy cost and high capital cost of central station power generating plants, every opportunity possible is being pursued to improve the efficiency and load carrying capability of existing nuclear power plants.

SUMMARY OF THE INVENTION

In general, a moisture separator reheater, when made in accordance with this invention, comprises a generally horizontally disposed cylindrical shell, a head on each end of the shell forming end closures for the moisture separator reheater, a plurality of long tubes disposed in a generally parallel array to form a generally round tube bundle with the top and bottom portions of the tube bundle generally flattened, a tube sheet having a plurality of holes which receive at least one end of the tubes. The ends of the tubes are seal welded in the tube holes. A plurality of tube supports are spaced along the length of the tube bundle and a pair of arcuate plates are disposed on opposite sides of the tube bundle and fastened to the tube supports forming a wrapper subtending the round portion of the tube bundle. A pair of cylindrically shaped plates are disposed longitudinally in the central portion of the shell. The cylindrically shaped plates have generally horizontal upper and lower margins which generally extend the length of the shell. A plurality of upper plate portions extend from the upper margins of the cylindrically shaped plates to the upper portion of the shell and a plurality of lower plates extend from the lower margins of the cylindrically shaped plates to the lower portion of the shell. The upper, lower and cylindrically shaped plates and shell are cooperatively associated in a sealed relationship to form within the shell a central chamber flanked by two side chambers. Openings in the lower plates place the side chambers in fluid communication with the central chamber. Moisture separators are disposed in the fluid path between the central and side chambers. A tongue and groove juncture is disposed between adjacent arcuate and cylindrically shaped plates. The tongue and groove juncture generally extends the length of the plates to provide a seal between the arcuate and cylindrical plates and to allow easy installation and removal of the tube bundle with respect to the central chamber. An inlet is disposed in fluid communication with the side chambers and an outlet is disposed in fluid communication with the upper portion of the central chamber whereby motive steam has its moisture removed and is heated as it passes over the outer side of the tube bundle.

BRIEF DESCRIPTION OF THE DRAWINGS

The objects and advantages of this invention will become more apparent from reading the following detailed description in conjunction with the accompanying drawings, in which.

DESCRIPTION OF THE PREFERRED EMBODIMENT

Figure 1:
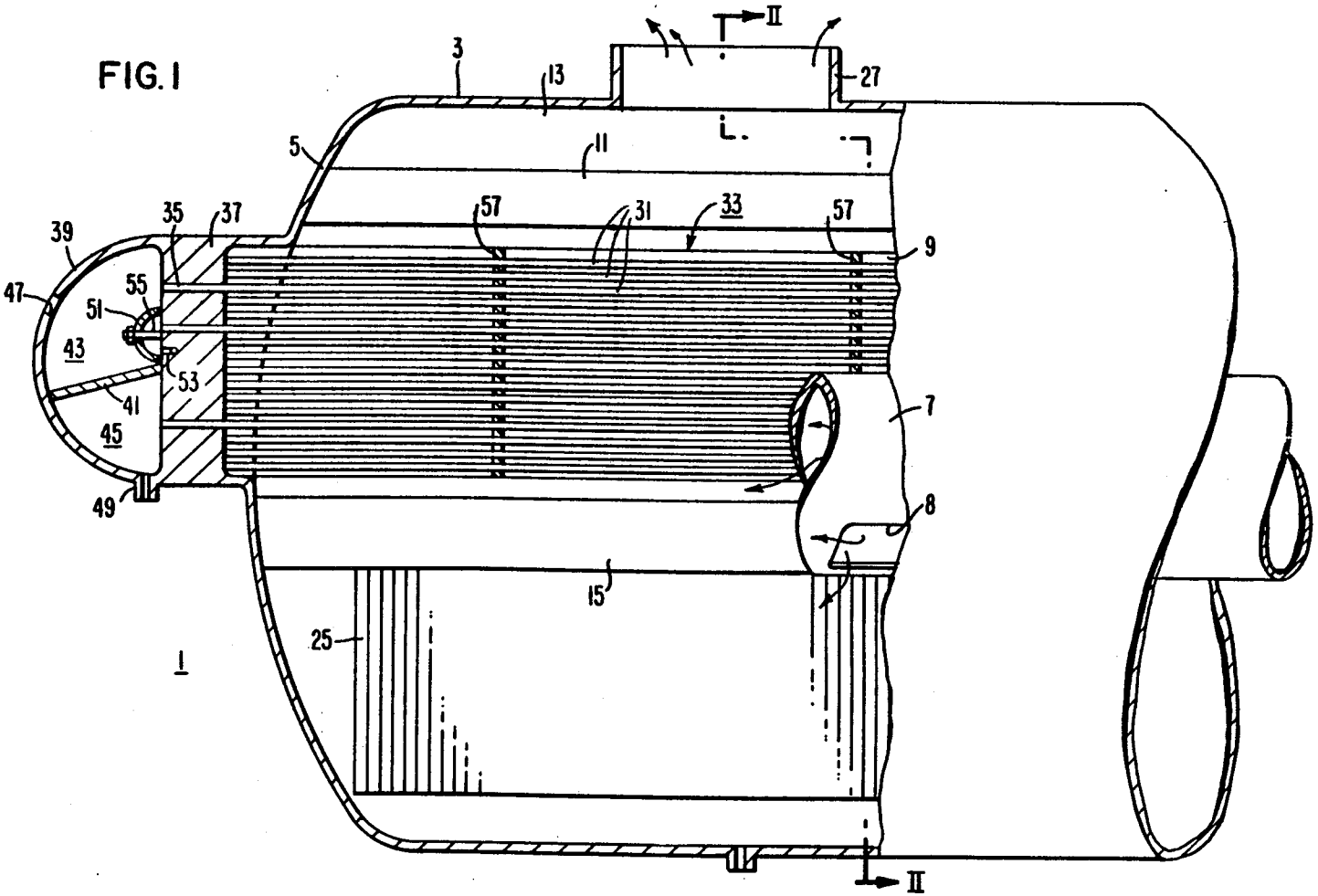
FIG. 1 is a partial elevational view of a moisture separator reheater partially in section.
Figure 2:
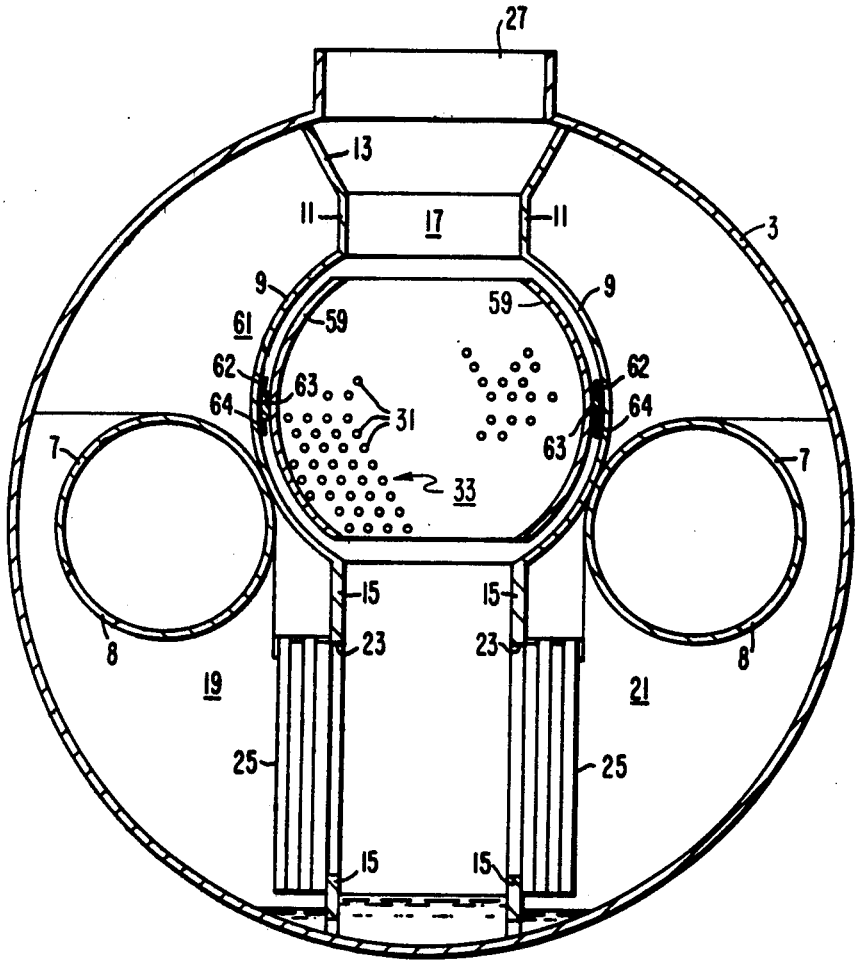
FIG. 2 is a sectional view taken on line II—II of FIG. 1.

Referring now to the drawings in detail, there is shown a moisture separator reheater 1 comprising a generally horizontal elongated cylindrical shell portion 3 having a head 5 disposed on each end thereof (only one is shown) which form end closures for the shell 3. A motive steam inlet nozzle (not shown) is in fluid communication with a pair of distribution manifolds 7 which are disposed horizontally within the shell 3. A plurality of distribution slots 8 are disposed along the length of the distribution manifold 7 to distribute motive steam evenly throughout the shell 3.

A pair of cylindrically shaped plates 9 are disposed longitudinally in the central portion of the shell 3. The plates 9 have generally horizontally disposed parallel upper and lower margins. A plurality of generally flat upper plates 11 and 13 extend from the upper margins of the cylindrical plates 9 to the upper portion of the shell 3. A plurality of generally flat lower plates 15 extend from the lower margins of the cylindrical plates 9 to the lower portion of the shell. The plates 9, 11, 13 and 15 cooperate with the shell in a sealed relationship to form within the shell a central chamber 17 flanked by two side chambers 19 and 21. The lower plates 15 have openings 23, placing the side chambers 19 and 21 in fluid communication with the central chamber 17. Disposed adjacent the openings 23 is a chevron-shaped moisture separator or other moisture separating means 25. The lower plates 15 may also end at the separator 25. A motive fluid outlet nozzle 27 is disposed in the upper portion of the shell 3 in fluid communication with the central chamber 17.

A plurality of long tubes 31 are disposed on a triangular pitch in a generally parallel array to form a generally round tube bundle 33 with flat top and bottom portions. At least one end of the tubes 31 extend through holes 35 in a tubesheet 37. The ends of the tubes are preferably seal welded to the tubesheet 37. In the preferred embodiment, U-shaped tubes are utilized, however, it is understood that straight tubes and a floating head could be used.

A hemispherical head 39 is attached to the tubesheet 37 by welding or other means and has a dividing plate 41 disposed therein to form two chambers 43 and 45 within the head 39. The chamber 43 has a heating steam inlet nozzle 47 in fluid communication therewith and the chamber 45 has a drain nozzle 49 in fluid communication therewith.

A manifold 51 is disposed in the chamber 43 and is in fluid communication with a plurality of tubes 31 having smaller radius bends. Also in fluid communication with the manifold 51 are two intersecting holes 53 drilled at right angles in the tubesheet. The holes 53 form a drain for draining fluid from the manifold 51. The manifold 51 is held in a sealed relationship with the tubesheet by studs 55 which fasten to holes in the tubesheet.

A plurality of tube supports 57 preferably formed from plates are spaced longitudinally along the length of the tube bundle 33, normal to the tubes 31 to maintain the spacing between the tubes 31. Disposed along each side of the tube bundle 33 and fastened to the tube support plates 57 by welding or other means are a pair of arcuate plates 59, which are generally disposed along the length of the tube bundle 33 adjacent the generally round portion thereof. The arcuate plates 59 form a wrapper which subtends only the generally round sides of the tube bundle 33 and add rigidity to the tube bundle and prevent it from damage as it is installed and removed from the shell 3.

Tongue and groove or other sliding sealed junctures 61 extend generally the length of the tube bundle 33 and are disposed between the arcuate plates 59 and the cylindrically shaped plates 9. The tongue and groove junctures 61 are formed from three flat bars 62, 63 and 64 slidably disposed adjacent each other. The central bar 63 being attached to one of the pairs of plates 59 and the other two bars 62 and 64 being attached to the other pairs of plates 9 to form a tongue and groove juncture which allows the tube bundle to slide in and out of the moisture separator reheater and form a seal between the wrapper plate 59 and the cylindrically shaped plates 9.

The moisture separator reheater hereinbefore described advantageously provides a generally round tube bundle 33, which replaces square or rectangular tube bundle arrangements and improves the heat rate of the moisture separator reheater by about 20 to 50 BTU's per kilowatt hour. The arcuate plates 59 form a wrapper significantly improving the structural rigidity of the tube bundle 33 to enhance bundle alignment within the moisture separator reheater. The tongue and groove juncture 61 between the wrapper 59 and the cylindrically shaped plates 9 in the central chamber 17 facilitate rapid removal and replacement of the round tube bundle 33 and provide a seal which is not affected by surges in pressure of the motive fluid.

What is claimed is:

1. A moisture separator reheater comprising:

a generally horizontally disposed cylindrical shell;

a head on each end of said shell forming end closures for said moisture separator reheater;

a plurality of long U-shaped tubes disposed in a generally parallel array to form a generally round tube bundle with shell side inlet and outlet portions of said tube bundle being generally flat;

a tubesheet having a plurality of holes which receive the ends of the tubes, said ends of said tubes being in a sealed relationship with said holes;

a plurality of tube supports spaced along the length of said tube bundle;

a pair of arcuate plates disposed on opposite sides of said tube bundle and fastened to said tube supports forming a wrapper subtending only the round portions of said tube bundle;

a pair of cylindrically shaped elongated plates disposed longitudinally in the central portion of said shell, said cylindrically shaped plates having generally horizontal upper and lower margins which generally extend the length of the shell;

a plurality of upper elongated plates which extend from the upper margins of said cylindrically shaped plates to the upper portions of the shell;

a plurality of lower elongated plates which extend downwardly from the lower margins of said cylindrically shaped plates toward the lower portion of said shell;

said upper, lower and cylindricaly shaped plates and said shell being cooperatively associated in a sealed relationship to form within the shell a central chamber flanked by two side chambers;

openings in said lower plates placing the side chambers in fluid communication with the central chamber;

moisture separating means disposed adjacent the openings in said lower plates;

a sliding sealed juncture disposed between adjacent arcuate and cylindrically shaped plates, said sliding sealed juncture generally extending the length of said plates to provide a seal and sliding engagement between said arcuate and cylindrically shaped plates to allow easy installation and removal of said tube bundle within said central chamber and to allow for differential thermal expansion between said arcuate and said cylindrical shaped plates;

a fluid inlet in fluid communication with each side chamber in said shell; and a fluid outlet in fluid communication with the upper portion of said central chamber in said shell to form a moisture separator reheater.

2. A moisture separator reheater as set forth in claim 1, wherein the sliding sealed juncture is formed by elongated flat bars generally horizontally disposed so the bars are slidably engaged in such a manner to prevent upward movement of said tube bundle due to the pressure differential caused by fluid flowing over the outer surface of the tubes.

3. A moisture separator reheater as set forth in claim 1 and further comprising a head disposed in a sealed relationship with the tubesheet, means for dividing said head into at least two chambers, a heating fluid supply nozzle in fluid communication with one of said head chambers, a manifold forming a vent chamber in fluid communication with a plurality of tubes, said manifold being so disposed that the fluid flowing through the tubes makes four passes through said central chamber.

4. A moisture separator reheater as set forth in claim 3 and further comprising a duct disposed in said tubesheet in fluid communication with said manifold for draining fluid from said manifold.

* * * * *